US005370087A

United States Patent [19]

Guimond et al.

[11] Patent Number: 5,370,087

[45] Date of Patent: Dec. 6, 1994

[54] LOW VIBRATION POLYMERIC COMPOSITE ENGINE

[75] Inventors: David P. Guimond, Stevensville; Rolf K. Muench, Annapolis, both of Md.

[73] Assignee: The United States of America as represented by the Secretary of the Navy, Washington, D.C.

[21] Appl. No.: 127,546

[22] Filed: Sep. 28, 1993

[51] Int. Cl.[5] ..... F02F 7/00

[52] U.S. Cl. ..... 123/546; 123/195 R

[58] Field of Search ..... 123/55 VS, 55 VF, 195 R, 123/193.3, 193.2, 41.74, 41.83, 41.84, 195 C

[56] References Cited

U.S. PATENT DOCUMENTS

| | | | |
|---|---|---|---|
| 4,446,827 | 5/1984 | Kubozuka | 123/195 R |
| 4,610,229 | 9/1986 | Wissmann et al. | 123/195 R |
| 4,726,334 | 2/1988 | Holtzberg | 123/195 R |
| 4,848,292 | 7/1989 | Holtzberg | 123/193.3 |
| 4,930,470 | 6/1990 | Kabat et al. | 123/195 R |
| 4,947,807 | 8/1990 | Flaig et al. | 123/55 VF |
| 4,954,377 | 9/1990 | Fischer et al. | 428/36.1 |
| 5,083,537 | 1/1992 | Onofrio et al. | 123/195 R |
| 5,143,028 | 9/1992 | Takahashi | 123/55 VS |

*Primary Examiner*—David A. Okonsky
*Assistant Examiner*—M. Macy
*Attorney, Agent, or Firm*—Gary G. Borda

[57] ABSTRACT

An internal combustion engine is constructed with metallic parts in its regions which are subjected to high stress (temperature, pressure) during combustion and polymeric materials in its regions which are subjected to relatively lower stresses. The integrated construction helps realize increased power densities and reductions in engine noise without compromising engine performance. V-configuration Diesel engines particularly benefit from this construction.

12 Claims, 2 Drawing Sheets

LOW VIBRATION POLYMERIC COMPOSITE ENGINE

BACKGROUND OF THE INVENTION

1. Field of the Invention

The invention is generally related to internal combustion engines and, more particularly, to V-configurations of internal combustion engines which are designed to have reduced engine weight and engine noise. The invention has specific utility for Diesel engine designs.

2. Description of the Prior Art

Internal combustion engines, such as gasoline piston engines or Diesel engines, operate by burning fuel within the engine proper rather than in an external furnace, as is done in a steam engine. Many internal combustion engines could benefit from being constructed with lighter weight materials, thereby increasing power density (horsepower produced per pound of engine weight). In addition, achieving noise reduction for the internal combustion engine without compromising the power density would be beneficial.

Diesel engines use the heat of highly compressed air to ignite a spray of fuel introduced after the start of the compression stroke. The combustion process in a Diesel engine is characterized by high cylinder pressures. Because of this high pressure, Diesel engine components typically have added material for extra strength which makes them heavier than gasoline engines. The Diesel combustion process also produces a very rapid rise in combustion pressure which is the cause of the Diesel engine's noise. Usually additional material is incorporated into the Diesel structure to minimize radiated noise. The additional material added to handle the large combustion pressures and noise of a Diesel engine decrease the power density.

SUMMARY OF THE INVENTION

It is an object of this invention to provide an internal combustion engine design with reduced amounts of metal, but which retains the stiffness required for proper engine functioning.

According to the invention, the conventional all metal Diesel engine has been modified by substituting significant amounts of light weight composite materials for the traditionally used cast iron materials. The use of the composite materials results in considerable weight savings and will enhance the power density of the engine. Moreover, the composite materials can be selected and tailored to have superior damping properties for reducing noises emanating from the engine, such as piston slap, etc. The operational integrity of the engine is not compromised because the composite materials are incorporated into the engine at regions of lower stress.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

During internal combustion, some of the engine's parts are subjected to high stresses while others experience relatively lower stresses. This invention contemplates substituting polymer composite materials for some of the cast iron that is traditionally used for internal combustion engine components. The polymer composite materials will be used only at the lower stress portions of the engine and will be integrated together with the metallic and/or cast iron portions of the engine to create a lighter weight engine. In addition to providing for enhanced power density, the polymer composite materials will be constructed to help reduce engine noise.

Figure 1:
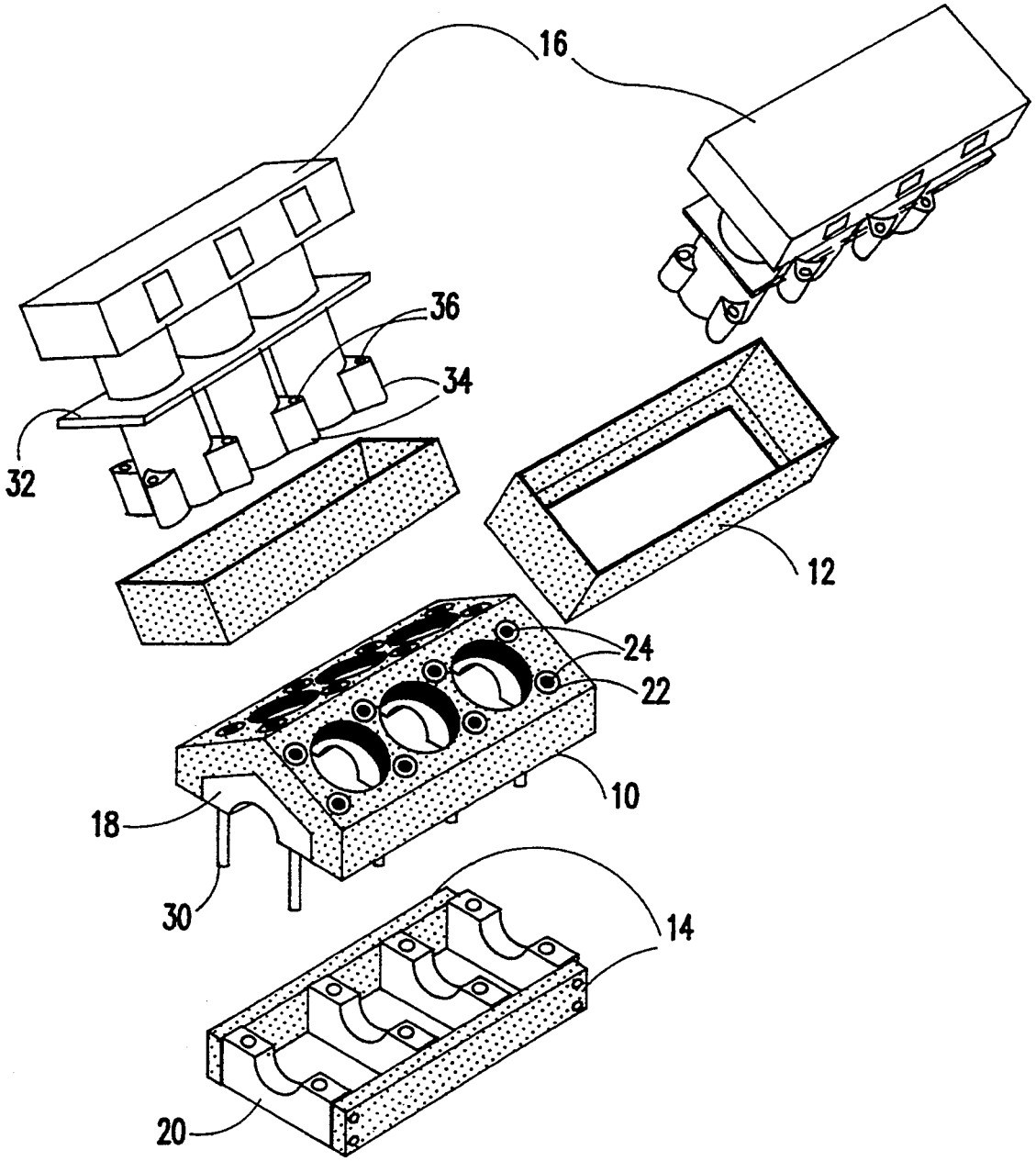
FIG. 1 is an isometric view of the component parts of a V configuration Diesel engine.

FIG. 1 shows the component parts of a V-configuration Diesel engine within the scope of this invention which employs polymer composite components at low stress sites and cast iron or metallic members at high stress sites. Specifically, the crank case 10, cylinder case 12, and bearing cap support bars 14 are made of a polymer composite material, while the cylinder banks 16, bearing inserts 18, and bearing caps 20 are made of cast iron, steel, metallic alloys, metal matrix composite materials, or other metallic materials. The polymer composite material is not subjected to combustion temperatures, but must be able to withstand the coolant and lubricant temperatures encountered during operation of the engine. Examples of suitable polymer matrix materials include polyester resin, epoxy resins, petroleum resins, acrylic resins, vinyl ester resins, and poly(arylene ether) ketones. In addition to withstanding heat of the engine, the polymer composite components should have a suitable mechanical strength commensurate with the application. Incorporating fibers with high tensile strengths and high moduli of elasticity will improve the mechanical rigidity of components used at the low stress sites that are formed from a polymeric composite material. Fibers which are most suitable include glass, carbon, boron, liquid crystal polymer, polyamides, polyaramides, polyester and/or metal fibers. The fibers can be embedded in the polymer as short, individual units or be present as long, continuous members. Furthermore, the fibers can be incorporated into the polymer matrix in woven, twisted pair, multilayer, isotropic or anisotropic fashion.

Using polymer composite materials in place of cast iron in an internal combustion engine results in considerable weight savings and, thus, significantly enhances power density. By selectively using polymeric composite components at lower stress sites in the engine, the integrity of the engine during operation is preserved. Furthermore, the polymer composite components can serve the function of reducing engine noise by dampening vibrations produced during operation of the engine (combustion pressure spikes, piston slap, etc.) without adding weight to the engine.

Vibration damping is a function of several operational and material variables including temperature, frequency, amplitude, degree of cure, fiber placement and orientation, etc. The polymer composite components used in the engine configuration of this invention could ideally utilize a viscoelastic matrix material or include a viscoelastic region which operates in conjunction with fiber reinforcements to dampen the noise. For example, U.S. Pat. No. 4,954,377 to Fischer et al., which is herein incorporated by referenced and which is assigned to the United States Navy, discloses that a multidimensionally braided textile shape positioned within a viscoelastic material can provide a high strength, load bearing structure, which can dampen noise by having the braided strands induce shear into the viscoelastic material. Other examples of matrix materials and fiber/-matrix arrangements which may be employed in the polymer composite components of this invention can be found in U.S. Pat. No. 4,859,523 to Endoh et al. which discloses a particular viscoelastic resin, U.S. Pat. No. 4,278,726 to Wieme which shows the use of twisted fiber bundles embedded in a viscoelastic layer, and U.S. Pat. No. 4,217,832 to Whitney which shows the use of a fiber mesh reinforcement as a backing for a viscoelastic material.

Figures 2A, 2B:
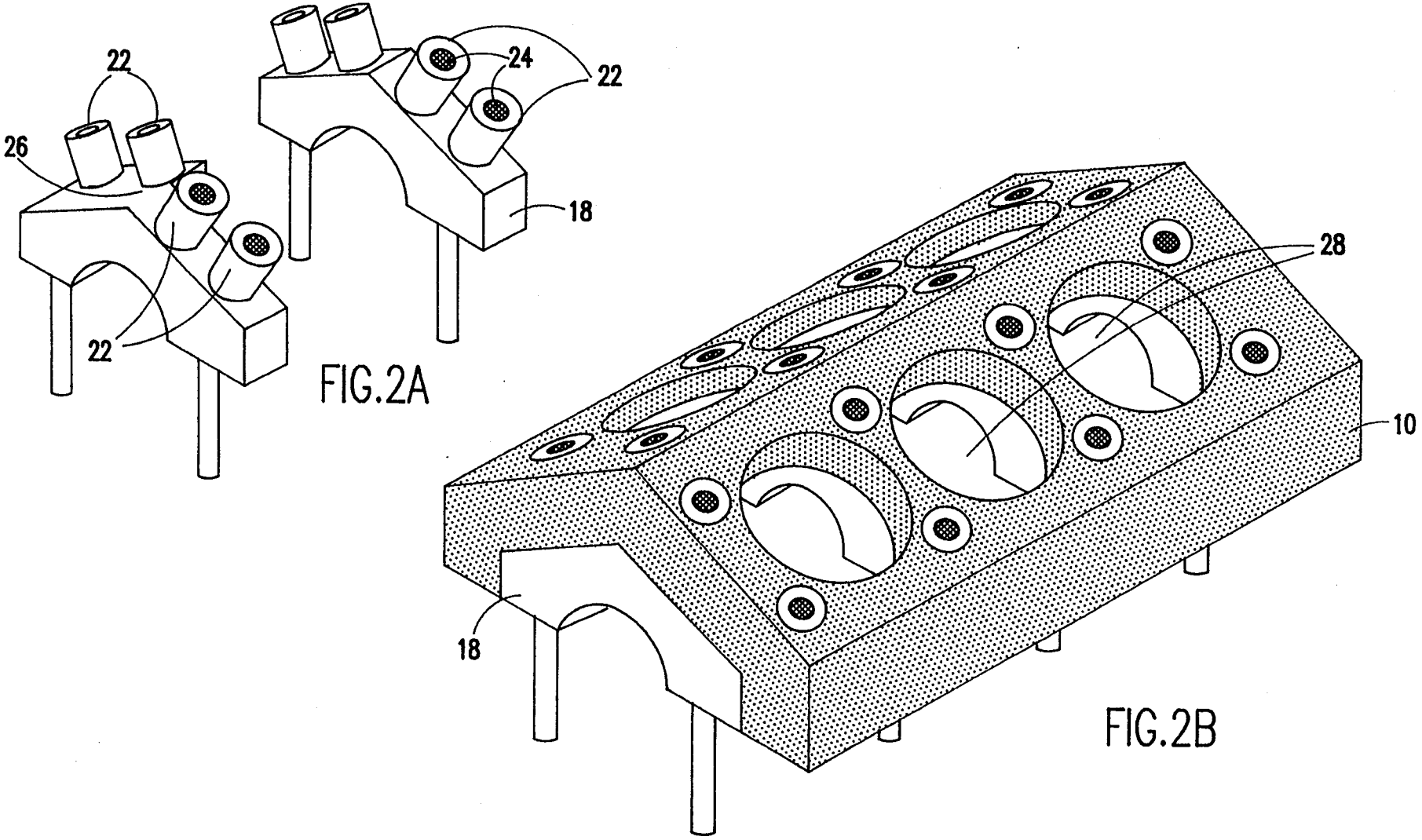
FIGS. 2*a* and 2*b* are isometric views of main bearing inserts and a composite crank case integrating the bearing inserts, respectively.

With reference to FIGS. 1, 2*a* and 2*b*, it can be seen that the V-configuration Diesel engine is compactly formed by integrally joining the polymer composite materials to the metallic components, and by bolting the metallic components to other metallic components. Specifically, FIG. 2*a* shows the steel main bearing inserts 18 include bosses 22 which will pass through the composite crank case 10. Each of the bosses 22 are tapped 24 for screw threads for positively and rigidly joining with the cast iron monoblock cylinder banks 16. FIG. 2*a* shows that the inserts which will be positioned at the ends of the crank case can have the bosses 22 offset on either side of the V ridge 26 to accommodate a slight offset of the cylinder banks 16 relative to one another. FIG. 2*b* shows that four bearing inserts 18 are joined to a composite crank case 10 to accommodate six cylinders, in a V-configuration, which fit into openings 28; however, it should be understood that a larger or smaller number of cylinders could be used. Furthermore, the invention could be practiced with in-line, slant, and other engine configurations, and the cylinders need not be present as a bank of cylinders.

An important feature shown in FIG. 2*b* is that the main bearing support inserts 18 are integrally joined to the composite crankcase 10. The exterior surfaces of the bearing support inserts 18 are covered by the polymer composite material of the crank case 10, and the regions between each of the four inserts 18 utilize polymer composite materials instead of the traditional cast iron. Use of the polymer composite material for the crank case 10 results in considerable weight savings and can provide some vibration and/or sound dampening. Preferably the bosses 22 of the main bearing support inserts 18 are flush with or slightly protruding from the upper surfaces of the crank case 10. The crank case 10 can be formed by a number of different molding processes and it is anticipated that the crank case 10 could be formed with the bosses 22 of the main bearing inserts 18 in situ or that a molded article could be drilled with holes for the bosses 22 and openings 28 for the cylinders.

FIG. 1 shows the use of steel main bearing caps 20; however, the caps may also be made of polymer composite materials. The bearing caps 20 are secured to the bearing support inserts 18 within the composite crank case 10 using cap bolts or studs 30, or by some other means. The bearing caps 20 are joined together on two sides in the longitudinal direction by support bars 14 which may be made of a polymer composite material. The support bars 14 can be joined to the bearing caps 20 using bolts or other connectors. As with the crank case 10, FIG. 1 shows that composite materials can be used to space the bearing caps 20 apart. The composite material used in the crank case 10 and the bearing cap support bars 14 should be of sufficient mechanical strength to maintain the spacing between each of the bearing inserts 18 and bearing caps 20. Having both the crank case 10 and the bearing cap support bars 14 made of a polymer material provides for an engine which has in its lower portion all metallic components completely integrated and housed within a polymeric material housing.

FIG. 1 shows that the upper portion of the engine includes two monoblock cylinder banks 16. Each monoblock cylinder bank 16 is a one piece metal casting which performs the function of the cylinder head/combustion chamber and the cylinder liner. The use of a one piece casting eliminates the need for a cylinder head gasket and the associated high bolt loads necessary to assure adequate sealing at the traditional cylinder head-gasket-engine block interface. Each casting has a divider plate 32 located perpendicular to the longitudinal axes of the cylinder liners. Composite cylinder cases 12 slip over the bottom of each cylinder bank 16 and are fastened to the divider plate 32 at one end and sealed against the bottom of the head portion of the cylinder bank 16. The open area between the monoblock cylinder bank 16 and the composite cylinder case 12 forms the cooling jacket for the cylinder liners. In addition to being an integral part of the engine, the composite cylinder case acts as a light weight vibration/sound dampening device. The portion of the cylinder banks 16 which are not covered by the composite cylinder cases 12 can be encased by composite panels to further dampen noise generated by combustion and piston slap.

The monoblock cylinder banks 16 incorporate lugs 34 which can be drilled with through holes 36. Ideally, the cylinder banks 16 are fastened to the crankcase 10 with bolts which pass through the mounting lugs 34 and are threaded into tapped openings 24 in the bosses 22 of the metal main bearing support inserts 18. The metal to metal joint between the cylinder banks 16 and the main bearing support inserts 18 together with the metal to metal joint between the bearing support inserts 18 and the main bearing caps 20 assure a rigid and durable stack up of the components which are in the direct load path of the combustion forces. Although not specifically shown in FIG. 1, it is preferable that each cylinder bank 16 provide for O-ring type seals around the circumference of each cylinder bore.

The reductions in engine weight and noise described above could be further enhanced through the incorporation of additional components made from polymer composite materials which are not shown. These could include, but are not limited to, the oil pan, valve covers, and the air intake manifold.

While the invention has been described in terms of its preferred embodiments, those skilled in the art will recognize that the invention can be practiced with modification within the spirit and scope of the appended claims.

We claim:

1. An internal combustion engine, comprising:

high stress portions which are positioned in a direct load path of combustion forces produced during operation of said internal combustion engine and which are subjected to intense combustion pressure, said high stress portions being formed from metallic materials selected from the group consisting of cast iron, steel, metallic alloys, and metal matrix composite materials, said high stress portions comprising a plurality of cylinders and bearing members, said cylinders and bearing members being joined together at a plurality of metal to metal joints such that a suck up of said high stress portions results so as to provide a rigidity and durability necessary to withstand said intense combustion pressure; and low stress portions which are integrally joined to said high stress portions, but which are not positioned in said direct load path of said combustion forces produced during operation of said internal combustion engine and which are subjected to lower pressures than said high stress portions during combustion, said low stress portions comprising a crank case, at least one cylinder case, and bearing cap support members for holding said bearing members in a spaced alignment, at least one of said low stress portions being formed from a polymer material.

2. The internal combustion engine of claim 1 wherein each of said bearing members includes a bearing cap and a bearing support insert, said bearing cap support members being integrally joined with said bearing caps of said bearing members, said crank case being formed from said polymer material and being integrally joined with said bearing support inserts of said bearing members, said bearing support inserts being positioned on an inside surface of said crank case and said cylinders being positioned on an outside surface of said crank case, each of said bearing support inserts including a load bearing metallic material connection means which extends through said crank case for connecting said bearing support inserts with said cylinders wherein said connection means is in said direct load path of said combustion forces.

3. The internal combustion engine of claim 2 wherein said bearing support inserts are spaced apart a sufficient distance to accommodate the positioning of a cylinder between adjacent bearing support inserts, said cylinders include a plurality of lugs extending radially from a bottom region of said cylinders and said connection means comprise a plurality of bosses for connecting with said lugs.

4. The internal combustion engine of claim 1 wherein said polymer material used for said low stress portions is reinforced with fibers, said fiber reinforced polymer material comprising multidimension by braided fibers in a viscoelastic matrix material whereby said reinforced polymer material is capable of dampening noise and vibrations produced during combustion.

5. The internal combustion engine of claim 1 wherein said polymer material is reinforced with fibers.

6. The internal combustion engine of claim 5 wherein said fibers are selected from the group consisting of glass, carbon, boron, liquid crystal polymer, polyamides, polyaramides, polyester and metal fibers.

7. The internal combustion engine of claim 1 wherein said polymer material is selected from the group consisting of polyester resins, epoxy resins, petroleum resins, acrylic resins, vinyl ester resins, and poly(arylene ether) ketones.

8. The internal combustion engine of claim 1 wherein said at least one cylinder case is formed from said polymer material and wherein each cylinder includes a cylinder liner and a cylinder .head .defining a combustion chamber, said cylinders being connected together as at least one integrally molded monoblock cylinder bank, said at least one cylinder bank having a laterally extending divider plate positioned between a bottom of said cylinder bank and said cylinder heads and extending perpendicular to longitudinal axes of said cylinder liners, said at least one cylinder case being constructed for use as a cooling jacket for said at least one cylinder bank by having a top edge connected to said cylinder heads and a bottom edge connected to said divider plate, and having a middle region which is spaced away from said at least one cylinder bank to accommodate coolant between said liners of said cylinders in said at least one cylinder bank and said at least one cylinder case.

9. The internal combustion engine of claim 8 wherein said polymer material of said at least one cylinder case is reinforced with fibers, said fiber reinforced polymer material comprising multidimensionally braided fibers in a viscoelastic matrix material whereby said at least one cylinder case is capable of dampening noise and vibrations produced during combustion in said cylinders.

10. The internal combustion engine of claim 1 wherein said bearing cap support members are formed from said polymer material.

11. The internal combustion engine of claim 1 wherein said crank case, said at least one cylinder case, and said bearing cap support members are formed from said polymer material.

12. The internal combustion engine of claim 1 wherein said crank case has a V-configuration and is formed from said polymer material, and wherein said cylinders are connected together to form at least two cylinder banks which are positioned on opposite sides of said V-configuration of said crank case.

* * * * *